United States Patent [19]

Alsup

[11] Patent Number: 4,505,425

[45] Date of Patent: Mar. 19, 1985

[54] TEAR OUT STRIP ON COIN TUBES AND COIN WRAPPERS

[76] Inventor: W. Homer Alsup, P.O. Box 6703, San Francisco, Calif. 94101

[21] Appl. No.: 471,683

[22] Filed: Mar. 3, 1983

[51] Int. Cl.[3] ..... B65D 75/06

[52] U.S. Cl. ..... 229/87.2; 133/1 A

[58] Field of Search ..... 133/1 A, 1 R, 8 A; 229/87.2

[56] References Cited

U.S. PATENT DOCUMENTS 1,337,941 4/1920 Morgan ..... 229/87.2

3,095,084 6/1963 White ..... 229/87.2 X

FOREIGN PATENT DOCUMENTS 2070563 9/1981 United Kingdom ..... 229/87.2

*Primary Examiner*—Stanley H. Tollberg

[57] ABSTRACT

A tube-type coin wrapper formed of a flexible material has a tear out strip along one side thereof which is perforated for easy removal of coins therefrom. An open slot or window is provided for easy gripping of the tear out strip. Removal of the strip retains the structural integrity of the wrapper to form a serving tray for the coins contained therein.

4 Claims, 3 Drawing Figures

TEAR OUT STRIP ON COIN TUBES AND COIN WRAPPERS

BACKGROUND OF INVENTION

Many types of coin wrappers have been known in the art for many years. Coin wrappers are commonly formed of a flexible material such as paper or the like to fit tightly around a stack of coins and forming a cylindrical roll. A predetermined number of coins is contained in each wrapper and the number of coins in each is standardized for easy recognition and counting. The coin wrappers are generally sealed at each end to avoid inadvertant opening of the roll and loss of the coins contained therein. Occasionally, coin wrappers are made to be pre-formed having ridges or the like to contain coins inserted therein within the wrapper. Automatic coin wrapping machines are used with conventional wrappers for tightly wrapping large numbers of coins and are used, for example, in banks, gambling casinos and large stores.

Conventional coin wrappers, when filled with coins and sealed, are commonly opened in two ways: the user grasps the roll of coins in one hand and tries to tear a hole in the wrapper, either at one end thereof or the center, or snaps the wrapped roll of coins against a sharp surface, as against the edge of a counter or the like. These methods result either in coins being scattered, as in the second method, or frequently, nails being broken.

The present invention provides a simple, low cost coin wrapper with an easy pull away tab to facilitate opening of a roll of wrapped coins and after opening this roll becomes a holder for the coins contained therein from which coins may be easily stored and withdrawn, thereby overcoming the problems existing in the prior art.

BRIEF DESCRIPTION OF DRAWINGS

The present invention is illustrated with respect to a particular preferred embodiment as described below.

1.

SPECIFICATION

The unique tear out strip of the present invention is designed to overcome the problem of opening a tightly wrapped roll of coins, particularly those wrapped by machine. The tear away strip of this invention is different from the prior art because of the unique opening or window at each end of the strip which exposes the end for easy grasping by a user.

It will be seen from the accompanying drawings that the present invention is comprised of a coin wrapper or coin tube A made of a flexible material such as paper, which is rolled, either by hand or machine around a stack of a predetermined number of coins F to contain the coins in the wrapper or tube for easy storage and counting.

Figure 1:
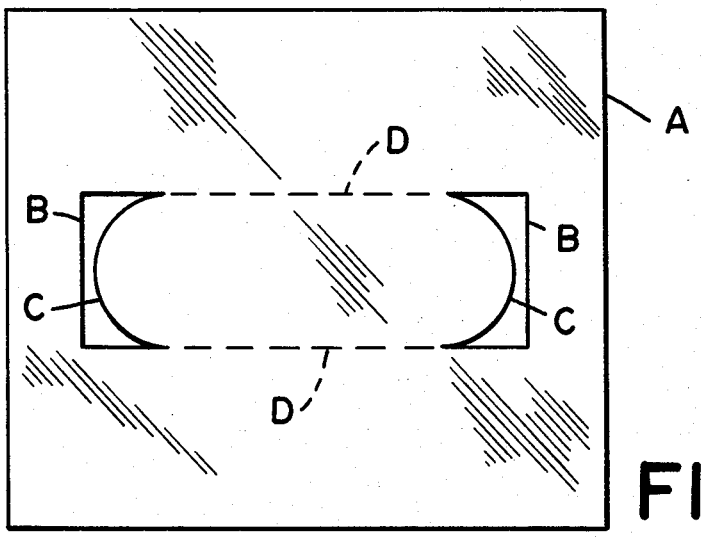
FIG. 1 shows a coin tube flat with the tear away slot of the present invention and showing the pull tab and perforated line.
2.
Figure 2:
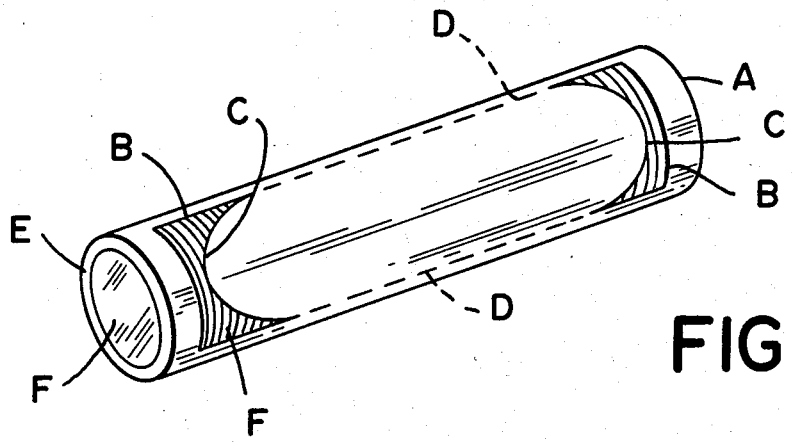
FIG. 2 shows the coin tube of FIG. 1 rolled around a stack of coins and sealed.
3.
Figure 3:
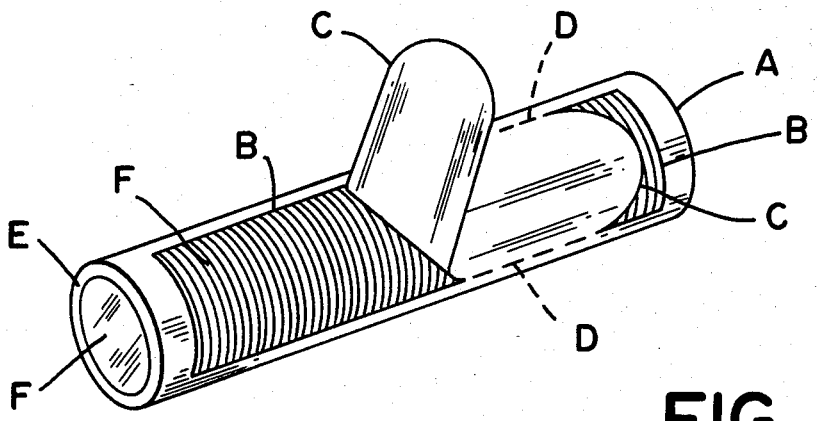
FIG. 3 shows the coin tube of FIG. 1 with part of the tear away tab pulled back exposing the coins contained therein and illustrating the shape of the coin holder.

As will be seen in FIG. 1, the coin wrapper A has a tear away pull tab C extending from approximately 10% from the first end of the coin wrapper to about 10% of the other end of the coin wrapper. This tear away pull tab C has a generally rectangular shape with curved edges at the narrow ends of the rectangle. The tear away tab C of the present invention has perforated lines D along the long or non-curved sides of the rectangle and these are illustrated in FIGS. 1, 2 and 3. An opening or window B is provided at each end of the tear away tab C to allow easy access to the ends of the tear away tab C.

Operation of the present invention is extremely easy. Filling of the wrapper or tube with coins may be accomplished in the conventional manner. In the instance of a wrapper rolled around a stack of coins by machine or hand, the coins are placed inside and the ends E are rolled tightly to prevent the coins from slipping out at either end. Coin tubes are merely filled and the ends thereof sealed to prevent coins from escaping.

Opening of the present invention is readily accomplished by placing a finger inside the slot B and grasping the pull tab C. Pulling upward on the tab C causes the tab C to separate from the tube A along the perforated line D and form an opening to remove the coins F contained within the wrapper easily.

If it is desired to remove only a few coins from the roll, the tab C may be pulled away only a short distance from the slot B. Similarly, if it is desired to expose all of the coins F it will be necessary to pull the tab away the complete distance. Removal of the tear away pull tab C from the coin tube of the present invention leaves the user with a practical and handy recepticle or holder for the remainder of the coins. This serving tray allows instant use of the coins contained in the present invention.

Although the present invention has been described above with respect to a single preferred embodiment, it will be appreciated by those skilled in the art that numerous modifications are possible within the breadth and scope of the invention. One such embodiment may be used to wrap and open the wrappers of stacks of appliance washers, screws, buttons, etc. It is thus not intended to limit the invention to the precise terms of description or details of illustration.

I claim:

1. A coin wrapper or coin tube of flexible nonresilient material having a tear out strip of generally rectangular shape disposed a distance within the margin of the wrapper, said tear out strip having a width comprising approximately 30% of the circumference of the wrapper in rolled up configuration, said tear out strip having tear lines along two elongated edges thereof, said tear out strip having a curved edge along at least one narrow end thereof, said wrapper defined a window opening at the curved end of said tear out strip and spaced from the end of the wrapper in rolled up configuration for grasping said tear out strip to remove same at least in part for defining a coin holder from which coins may be readily removed while retaining the remainder of the coins.

2. The coin wrapper of claim 1 further defined by the tear lines along the sides of said tear out strip comprising perforations along the two elongated edges thereof, said curved edge of said strip comprising a curved pull tab at the narrow edge thereof, and said window opening extending across said pull tab between the body of the coin wrapper and the curved edge of the pull tab.

3. The coin wrapper or coin tube of claim 1 further defined by window openings at both narrow ends of the tear out strip for grasping the curved ends of the pull tab to readily remove same from the wrapper.

4. The coin wrapper or coin tube of claim 3 further defined by said openings or windows forming, with the tear away strip and pull tab removed, a serving tray for the coins contained therein, wherein removal of the coins individually or in combination is readily accomplished.

* * * * *